US006458018B1

(12) United States Patent
Goers et al.

(10) Patent No.: US 6,458,018 B1
(45) **Date of Patent: *Oct. 1, 2002**

(54) ABRASIVE ARTICLE SUITABLE FOR ABRADING GLASS AND GLASS CERAMIC WORKPIECES

(75) Inventors: Brain D. Goers, Minneapolis; Scott W. Peterson, Eagan; Edward J. Woo, Woodbury, all of MN (US)

(73) Assignee: 3M Innovative Properties Company, St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/298,341

(22) Filed: Apr. 23, 1999

(51) Int. Cl.[7] ..... B24B 7/22; B24D 01/00

(52) U.S. Cl. ..... 451/41; 451/533; 451/921; 51/293

(58) Field of Search ..... 451/41, 921, 527, 451/530, 533, 534, 539; 51/307, 293

(56) References Cited

U.S. PATENT DOCUMENTS

| | | | |
|---|---|---|---|
| 1,910,444 A | 5/1933 | Nicholson | |
| 3,041,156 A | 6/1962 | Rowse et al. | |
| 3,270,467 A | 9/1966 | Block et al. | |
| 3,522,342 A | 7/1970 | Nungesser et al. | |
| 3,562,968 A | 2/1971 | Johnson et al. | |
| 3,667,170 A | 6/1972 | MacKay, Jr. | |
| 3,916,584 A | 11/1975 | Howard et al. | |
| 3,947,169 A | 3/1976 | Wolff et al. | |
| 4,255,164 A | 3/1981 | Butzke et al. | |
| 4,311,489 A | 1/1982 | Kressner | |
| 4,314,827 A | 2/1982 | Leitheiser et al. | |
| 4,328,322 A | 5/1982 | Baron | |

(List continued on next page.)

FOREIGN PATENT DOCUMENTS

| | | | |
|---|---|---|---|
| DE | 3330512 | | 11/1984 |
| EP | 0 650 803 B1 | | 5/1995 |
| EP | 0 833 309 A1 | | 4/1998 |
| GB | 1 327 653 | | 8/1973 |
| GB | 2 043 501 | | 10/1980 |
| WO | WO 95/00295 | | 1/1995 |
| WO | WO 95/07797 | | 3/1995 |
| WO | WO 95/194242 | | 7/1995 |
| WO | WO 95/22436 | | 8/1995 |
| WO | WO 96/33638 | | 10/1996 |
| WO | WO 97/05990 | | 2/1997 |
| WO | WO 97/11484 | | 3/1997 |
| WO | WO 97/14535 | | 4/1997 |
| WO | WO 98/10896 | * | 3/1998 |
| WO | WO 98/12021 | | 3/1998 |
| WO | Wo 98/39142 | * | 9/1998 |

OTHER PUBLICATIONS

Burns, "Getting Started in DCPD RIM Molding", *Plastics Technology*, pp. 62–69, Mar. 1989.

Burns, "Micro–Rim' Replaces Injection Molding in Electronic Encapsulation", *Plastics Technology*, pp. 39–44, (1998).

(List continued on next page.)

*Primary Examiner*—Robert A. Rose
(74) *Attorney, Agent, or Firm*—Scott R. Pribnow

(57) ABSTRACT

An abrasive article is provided which comprises a backing and at least one three-dimensional abrasive coating bonded to a surface of the backing. The abrasive coating comprises a binder formed from a cured binder precursor having dispersed therein a plurality of diamond bead abrasive particles and a filler which comprises from about 40 to about 60 percent weight of the abrasive coating. The abrasive article is particularly suitable for abrading a glass or a glass ceramic workpiece in the presence of a lubricant.

17 Claims, 2 Drawing Sheets

U.S. PATENT DOCUMENTS 4,364,746 A 12/1982 Biter et al.
4,541,842 A 9/1985 Rostoker
4,576,612 A 3/1986 Shukla et al.
4,609,581 A 9/1986 Ott
4,623,364 A 11/1986 Cottringer et al.
4,644,703 A 2/1987 Kaczmarek et al.
4,652,274 A 3/1987 Boettcher et al.
4,652,275 A 3/1987 Bloecher et al.
4,668,736 A 5/1987 Robins et al.
4,733,502 A 3/1988 Braun
4,733,920 A 3/1988 Pannbacker
4,735,632 A 4/1988 Oxman et al.
4,744,802 A 5/1988 Schwabel
4,751,138 A 6/1988 Tumey et al.
4,770,671 A 9/1988 Monroe et al.
4,773,920 A 9/1988 Chasman et al.
4,799,939 A 1/1989 Bleocher et al.
4,875,259 A 10/1989 Appeldorn
4,881,951 A 11/1989 Wood et al.
4,903,440 A 2/1990 Larson et al.
4,918,874 A 4/1990 Tiefenbach, Jr.
4,964,883 A 10/1990 Morris et al.
4,997,461 A 3/1991 Markhoff-Matheny et al.
5,009,675 A 4/1991 Kunz et al.
5,011,508 A 4/1991 Wald et al.
5,014,468 A 5/1991 Ravipati et al.
5,015,266 A 5/1991 Yamamoto
5,039,311 A 8/1991 Bloecher
5,042,991 A 8/1991 Kunz et al.
5,045,091 A 9/1991 Abrahamson et al.
5,077,870 A 1/1992 Melbye et al.
5,078,753 A 1/1992 Broberg et al.
5,106,394 A 4/1992 Bramson
5,136,818 A 8/1992 Bramson
5,152,917 A 10/1992 Pieper et al.
5,164,348 A 11/1992 Wood
5,174,795 A 12/1992 Wiand
5,213,591 A 5/1993 Celikkaya et al.
5,219,462 A 6/1993 Bruxvoort et al.
5,232,470 A 8/1993 Wiand
5,233,719 A 8/1993 Young et al.
5,233,794 A 8/1993 Kikutani et al.
5,236,472 A 8/1993 Kirk et al.
5,254,194 A 10/1993 Ott et al.
5,256,170 A 10/1993 Harmer et al.
5,273,558 A 12/1993 Nelson et al.
5,304,223 A 4/1994 Pieper et al.
5,316,812 A 5/1994 Stout et al.
5,400,458 A 3/1995 Rambosek
5,427,595 A 6/1995 Pihl et al.
5,460,883 A 10/1995 Barber, Jr. et al.
5,632,668 A 5/1997 Lindholm et al.
D381,139 S 7/1997 Johnson et al.
5,679,067 A 10/1997 Johnson et al.
5,849,052 A 12/1998 Barber, Jr.
5,888,119 A * 3/1999 Christianson et al. ..... 451/41
5,903,951 A 5/1999 Ionta et al.
5,910,471 A * 6/1999 Christianson et al. ..... 451/41
6,110,015 A 8/2000 Christianson et al.

OTHER PUBLICATIONS

"Engineering Polymers—Properties Guide: Thermoplastics and Polyurethanes", Brochure from the Polymers Division of Bayer Corporation, pp. 1–32 (1987).

Evans, "New Equipment for Lower–Cost RIM", *Plastics Technology*, pp. 37–39, (1990).

Fujiwara et al., "Reactive Processing of Thermostet/Thermoplastic Blends: A Potential for Injection Molding", *Polymer Engineering and Science*, vol. 36, No. 11, pp. 1541–1546 (1996).

"Injection Molding—Bucher upgrades thermoset technology", *Plastics World*, pp. 24–24 (1989).

Kim et al., "Rubber Modified Epoxy Resin. III: Reaction Injection Molding Process", *Polymer Engineering and Science*, vol. 3, pp. 564–576 (1995).

McMahon, "An introduction to reaction injection molding", *Advanced Materials & Processes*, pp. 37–38 (1995).

Muller et al., "New Developments in Isocyanate–Based Casting Resins for the Electrical and Electronics Industry", reprinted from *Advances in Urethane Science and Technology*, vol. 12, pp. 166–207 (undated).

Nguyen et al., "Processing of Polyurethane/Polyester Interpenetrating Polymer Networks by Reaction Injection Molding. Part III: Flow Reorientation Through Multiple Impingement", *Polymer Engineering and Science*, vol. 26, pp. 843–853 (1986).

Osinski, "Characterization of Fast–Cure Resins for Reaction Injection Molding", *Polymer Engineering and Science*, vol. 23, pp. 756–762 (1983).

Pannone et al., "Reaction Kinetics of a Polyurea Reaction Injection Molding System", *Polymer Engineering and Science*, vol. 28, pp. 660–669 (1988).

Schlotterbeck et al., "MATERIALS: Polyurea/Amide Elastomers—a New RIM Generation Debuts", *Plastics Engineering*, pp. 37–40 (1989).

Viola et al., "Isocyanate Trimerization Kinetics and Heat Transfer in Structural Reaction Injection Molding", *Polymer Engineering and Science*, vol. 34, No. 15, pp. 1173–1186 (1994).

Watts, "Abrasive Monofilaments—Critical Factors that Affect Brush Tool Performance", Society of Manufacturing Engineers Technical Paper (1988).

Willkomm et al., "Properties and Phase Separation of Reaction Injection Molded and Solution Polymerized Polyureas as a Function of Hard Block Content", *Polymer Engineering and Science*, vol. 2, pp. 888–900 (1988).

* cited by examiner

ABRASIVE ARTICLE SUITABLE FOR ABRADING GLASS AND GLASS CERAMIC WORKPIECES

BACKGROUND

The present invention pertains to an abrasive article and to a method of using the abrasive article to abrade a glass or glass ceramic workpiece.

Glass ceramics are known to be used as substrates for magnetic memory discs, for example, those used as storage devices (e.g., hard drives) in personal computers. In order to produce an acceptable magnetic memory disc, the memory disc substrate must have precisely controlled dimensions and a precisely controlled surface finish. Typically, dimensioning and imparting the desired surface finish to memory disc substrates has involved a multi-step process using loose abrasive slurries. In the first step of the process, the glass ceramic discs are dimensioned such that they have the desired thickness and thickness uniformity. After dimensioning, the discs are textured to provide the desired surface finish.

Although loose abrasive slurries are widely used in this process, loose abrasive slurries have many disadvantages associated with them. These disadvantages include the inconvenience of handling the required large volumes of the slurry, the required agitation to prevent settling of the abrasive particles and to assure a uniform concentration of abrasive particles at the polishing interface, and the need for additional equipment to prepare, handle, and dispose of or recover and recycle the loose abrasive slurry. Additionally, the slurry itself must be periodically analyzed to assure its quality and dispersion stability. Furthermore, pump heads, valves, feed lines, grinding laps, and other parts of the slurry supply equipment which contact the loose abrasive slurry eventually show undesirable wear. Further, the processes which use the slurry are usually very untidy because the loose abrasive slurry, which is a viscous liquid, splatters easily and is difficult to contain.

In view of the many disadvantages associated with using a slurry process to abrade (i.e., dimension or texture) glass ceramic memory disc substrates, what is desired in the industry is a fixed abrasive article suitable for abrading these substrates.

SUMMARY

The present invention provides an abrasive article which is suitable for abrading (i.e., dimensioning or polishing) a glass or a glass ceramic workpiece. The abrasive article comprises a backing and at least one three-dimensional abrasive coating bonded to a surface of the backing. The abrasive coating comprises a binder having dispersed therein a plurality of diamond bead abrasive particles and a filler. The filler comprises about 40 to about 60 percent weight of the abrasive coating, more preferably about 50 to about 60 percent weight of the abrasive coating.

It is preferred that the three-dimensional abrasive coating includes a plurality of abrasive composites. The plurality of abrasive composites can be precisely shaped composites, irregularly shaped composites or precisely shaped composites including a shape of a truncated pyramid having a flat top. Preferably, the precisely shaped composites have a bottom portion defining a surface area not more than 50%, more preferably, not more than 25% and most preferably, not more than 15% greater than the top surface area of the composites.

Preferably, the binder is formed from a binder precursor comprising an ethylenically unsaturated resin, for example, an acrylate resin. The ethylenically unsaturated monomer preferably is selected from the group of monofunctional acrylate monomers, difunctional acrylate monomers, trifunctional acrylate monomers, and mixtures thereof The abrasive particles in an abrasive article of the present invention comprise diamond bead abrasive particles. The diamond beads comprise a plurality of individual diamond particles which are held together by a metal oxide matrix, preferably a silicon oxide matrix. Preferably, the average size of the diamond bead abrasive particles is about 6 to about 100 micrometers.

Abrasive articles of the present invention have been found to be particularly suitable for abrading glass and glass ceramic workpieces. That is, abrasive articles of the present invention provide a high cut rate which is relatively constant over the life of the abrasive article when they are used with a lubricant to abrade a glass or a glass ceramic workpiece. Therefore, another aspect of the invention is directed to a method for abrading a glass or a glass ceramic workpiece comprising the steps of:

(a) contacting a glass or a glass ceramic workpiece with an abrasive article as described above;

(b) applying a lubricant at an interface between the workpiece and the abrasive article; and (c) moving the workpiece and the abrasive article relative to one another.

The three dimensional abrasive coating of the abrasive article comprises a binder having dispersed therein diamond bead abrasive particles and at least one filler in the amount of about 40 to about 60 percent weight of the abrasive coating. The level of filler is chosen to provide an abrasive coating which will erode under typically use conditions thereby exposing and releasing new diamond bead abrasive particles. Diamond bead abrasive particles are believed to be particularly suitable because their relatively large size inhibits them from being pressed into the abrasive coating. Also, it is believed that the diamond bead abrasive particles are less susceptible to developing wear flats (i.e., less susceptible to dulling) which may lead to a reduced cut rate.

In a preferred embodiment, the three dimensional abrasive coating has a precisely shaped surface. "Precisely shaped" as used herein, describes the abrasive composites which are formed by curing the binder precursor while the precursor is both being formed on a backing and filling a cavity on the surface of a production tool. These abrasive composites have a three dimensional shape that is defined by relatively smooth-surfaced sides that are bounded and joined by well-defined sharp edges having distinct edge lengths with distinct endpoints defined by the intersections of the various sides. This type of abrasive article is referred to as structured in the sense of the deployment of a plurality of such precisely-shaped abrasive. The abrasive composites may also have a irregular shape which, as used herein, means that the sides or boundaries forming the abrasive composite are slumped and not precise. In an irregularly shaped abrasive composite, the abrasive slurry is first formed into the desired shape and/or pattern. Once the abrasive slurry is formed, the binder precursor in the abrasive slurry is cured or solidified. There is generally a time gap between forming the shape and curing the binder precursor. During this time gap, the abrasive slurry will flow and/or slump, thereby causing some distortion in the formed shape. The abrasive composites can also vary in size, pitch, or shape in a single abrasive article, as described in WO 95/07797 (published Mar. 23, 1995) and WO 95/22436 (published Aug. 24, 1995).

"Boundary" as used herein, refers to the exposed surfaces and edges of each composite that delimit and define the actual three-dimensional shape of each abrasive composite. These boundaries are readily visible and discernible when a cross-section of an abrasive article of this invention is viewed under a microscope. These boundaries separate and distinguish one abrasive composite from another even if the composites abut each other along a common border at their bases. For precisely shaped abrasive composites, the boundaries and edges are sharp and distinct. By comparison, in an abrasive article that does not have precisely shaped composites, the boundaries and edges are not definitive (i.e., the abrasive composite sags before completion of its curing). These abrasive composites, whether precisely or irregularly shaped, can be of any geometrical shape defined by a substantially distinct and discernible boundary, wherein the precise geometrical shape is selected from the group consisting of cubic, prismatic, conical, block-like truncated conical, pyramidal, truncated pyramidal, cylindrical, hemispherical and the like.

"Texture" as used herein, refers to an abrasive coating having any of the aforementioned three dimensional composites, whether the individual three dimensional composites are precisely or irregularly shaped. The texture may be formed from a plurality of abrasive composites which all have substantially the same geometrical shape (i.e., the texture may be regular). Similarly, the texture may be in a random pattern where the geometrical shape differs from abrasive composite to abrasive composite.

DETAILED DESCRIPTION

Figure 1:
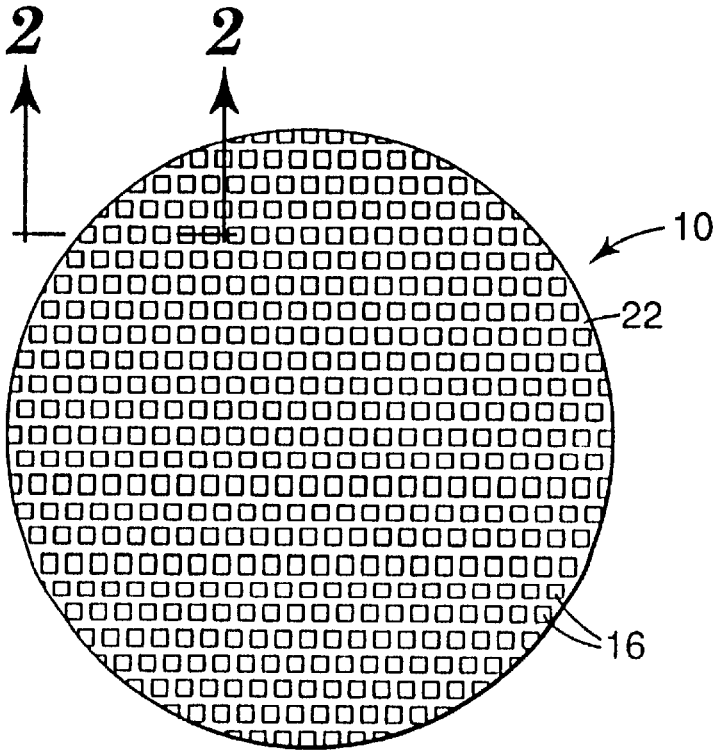
FIG. 1 is a plan view of one preferred abrasive article in accordance with the invention.

The present invention pertains to an abrasive article and a to a method of abrading a glass or a glass ceramic workpiece with the abrasive article. The abrasive article comprises a backing and at least one three-dimensional abrasive coating bonded to a surface of a backing. The abrasive coating comprises a binder formed from a cured binder precursor, a plurality of diamond bead abrasive particles, and a filler which comprises about 40 to about 60 percent weight of the abrasive coating. The abrasive coating may further comprise optional ingredients such as coupling agents, suspending agents, curing agents (e.g., initiators), photosensitizers and the like.

Binders

The binder is formed from a binder precursor. The binder precursor comprises a resin that is in an uncured or unpolymerized state. During the manufacture of the abrasive article, the resin in the binder precursor is polymerized or cured, such that a binder is formed. The binder precursor can comprise a condensation curable resin, an addition polymerizable resin, a free radical curable resin and/or combinations and blends thereof.

The preferred binder precursors are resins that polymerize via a free radical mechanism. The polymerization process is initiated by exposing the binder precursor, along with an appropriate catalyst, to an energy source such as thermal energy or radiation energy. Examples of radiation energy include electron beam, ultraviolet light or visible light.

Examples of free radical curable resins include acrylated urethanes, acrylated epoxies, acrylated polyesters, ethylenically unsaturated compounds, aminoplast derivatives having pendant unsaturated carbonyl groups, isocyanurate derivatives having at least one pendant acrylate group, isocyanate derivatives having at least one pendant acrylate group and mixtures and combinations thereof. The term acrylate encompasses acrylates and methacrylates.

Acrylated urethanes are also acrylate esters of hydroxy terminated isocyanate extended polyesters or polyethers. They can be aliphatic or aromatic. Examples of commercially available acrylated urethanes include those known by the trade designations PHOTOMER (e.g., PHOTOMER 6010) from Henkel Corp. Hoboken, N.J.; EBECRYL 220 (hexafunctional aromatic urethane acrylate of molecular weight 1000), EBECRYL 284 (aliphatic urethane diacrylate of 1200 molecular weight diluted with 1,6-hexanediol diacrylate), EBECRYL 4827 (aromatic urethane diacrylate of 1600 molecular weight), EBECRYL 4830 (aliphatic urethane diacrylate of 1200 molecular weigh diluted with tetraethylene glycol diacrylate), EBECRYL 6602 (trifunctional aromatic urethane acrylate of 1300 molecular weight diluted with trimethylolpropane ethoxy triacrylate), and EBECRYL 840 (aliphatic urethane diacrylate of 1000 molecular weight) from UCB Radcure Inc., Smyrna, Ga.; SARTOMER (e.g., SARTOMER 9635, 9645, 9655, 963-B80, 966-A80, etc.) from Sartomer Co., West Chester, Pa., and UVITHANE (e.g., UVITHANE 782) from Morton International, Chicago, Ill.

A urethane acrylate oligomer may be blended with an ethylenically unsaturated monomer. The preferred ethylenically unsaturated monomers are monofunctional acrylate monomers, difunctional acrylate monomers, trifunctional acrylate monomers or combinations thereof.

The ethylenically unsaturated monomers or oligomers, or acrylate monomers or oligomers may be monofunctional, difunctional, trifunctional or tetrafunctional or even higher functionality. The term acrylate includes both acrylates and methacrylates. Ethylenically unsaturated binder precursors include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of ethylenically unsaturated monomers include methyl methacrylate, ethyl methacrylate, styrene, divinylbenzene, hydroxy ethyl acrylate, hydroxy ethyl methacrylate, hydroxy propyl acrylate, hydroxy propyl methacrylate, hydroxy butyl acrylate, hydroxy butyl methacrylate, vinyl toluene, ethylene glycol diacrylate, polyethylene glycol diacrylate, ethylene glycol dimethacrylate, hexanediol diacrylate, triethylene glycol diacrylate, trimethylolpropane triacrylate, glycerol triacrylate, pentaerthyitol triacrylate, pentaerythritol trimethacrylate, pentaerythritol tetraacrylate and pentaerythritol tetramethacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2acryl-oxyethyl) isocyanurate, 1,3,5-tri(2-methacryloxyethyl)-s-triazine, acrylamide, methylacrylamide, N-methyl-acrylamide, N,N-dimethylacrylamide, N-vinylpyrrolidone, and N-vinylpiperidone, and CMD 3700, available from Radcure Specialties. Examples of ethylenically unsaturated diluents or monomers can be found in U.S. Pat. No. 5,236,472 (Kirk et al.) and U.S. Pat. No. 5,580,647 (Larson et al.).

Additional information concerning other potential useful binders and binder precursors can be found in assignee's patent application Ser. No. 08/694,014 (filed Aug. 8, 1996), which is a continuation-in-part of patent application Ser. No. 08/557,727 (filed Nov. 13, 1995, (Bruxvoort et al.) and U.S. Pat. No. 4,773,920 (Chasman et al.).

Acrylated epoxies are diacrylate esters of epoxy resins, such as the diacrylate esters of bisphenol A epoxy resin. Examples of commercially available acrylated epoxies include CMD 3500, CMD 3600, and CMD 3700, commercially available from Radcure Specialties, and CN103, CN104, CN111, CN 112 and CN 114 commercially available from Sartomer, West Chester, Pa.

Examples of polyester acrylates include Photomer 5007 and Photomer 5018 from Henkel Corporation, Hoboken, N.J.

The aminoplast resins have at least one pendant alpha, beta-unsaturated carbonyl group per molecule or oligomer. These unsaturated carbonyl groups can be acrylate, methacrylate or acrylamide type groups. Examples of such materials include N-(hydroxymethyl)-acrylamide, NN'-oxydimethylenebisacrylamide, ortho and para acrylamidomethylated phenol, acrylamidomethylated phenolic novolac and combinations thereof. These materials are further described in U.S. Pat. No. 4,903,440 (Larson et al.) and U.S. Pat. No. 5,236,472 (Kirk et al.).

Isocyanurate derivatives having at least one pendant acrylate group and isocyanate derivatives having at least one pendant acrylate group are further described in U.S. Pat. No. 4,652,27 (Boettcher). The preferred isocyanurate material is a triacrylate of tris(hydroxyethyl) isocyanurate.

A particularly preferred binder precursor comprises a mixture of about 30 parts tris(hydroxyethyl) isocyanurate (TATHEIC) and about 70 parts trimethylolpropane triacrylate (TMPTA). Such a mixture is commercially available under the trade designation "SR368D" from Sartomer Corporation, West Chester, Pa.

The binder precursor may also comprise an epoxy resin. Epoxy resins have an oxirane and are polymerized by ring opening. Such epoxide resins include monomeric epoxy resins and polymeric epoxy reins. Examples of some preferred epoxy resins include 2,2-bis[4-(2,3-epoxypropoxy)-phenyl)propane, a diglycidyl ether of bisphenol, commercially available materials under the trade designation EPON 828, EPON 1004 and EPON IOOIF available from Shell Chemical Co., and DER-331, DER-332 and DER-334 available from Dow Chemical Co. Other suitable epoxy resins include cycloaliphatic epoxies, glycidyl ethers of phenol formaldehyde novolac (e.g., DEN-431 and DEN-428 available from Dow Chemical Co. A blend of free radical curable resins and epoxy resins are further described in U.S. Pat. No. 4,751,138 (Tumey et al.) and U.S. Pat No. 5,256,170 (Harmer et al.).

Backing Materials

Backings serve the function of providing a support for the abrasive coating. Backings useful in the invention must be capable of adhering to the binder after exposure of binder precursor to curing conditions, and are preferably flexible after said exposure so that the articles used in the inventive method may conform to surface contours, radii and irregularities in the workpiece.

In many abrading applications, the backing needs to be strong and durable so that the resulting abrasive article is long lasting. Additionally, in some abrading applications the backing needs to be strong and flexible so that the abrasive article can conform uniformly to the glass workpiece. This is typically true, when the workpiece has a shape or contour associated with it. The backing can be a polymeric film, paper, vulcanized fiber, a treated nonwoven backing or a treated cloth backing to provide these properties of strength and conformability. It is preferred that the backing be a polymeric film. Examples of polymeric film include polyester film, co-polyester film, polyimide film, polyamide film and the like. A particularly preferred backing is a polyester film having prime coating of ethylene acrylic acid on at least one surface to promote adhesion of the abrasive coating to the backing.

A nonwoven, including paper, can be saturated with either a thermosetting or thermoplastic material to provide the necessary properties.

Cloth backings may also be suitable for an abrasive article of the present invention.

The cloth can be a J weight, X weight, Y weight or M weight cloth. The fibers or yarns forming the cloth can be selected from the group consisting of: polyester, nylon, rayon, cotton, fiberglass and combinations thereof. The cloth can be a knitted or woven cloth (e.g., drills, twills or sateen weaves) or it can be a stitchbonded or weft insertion cloth. The greige cloth can be textured, singed, desized or any conventional treatment for a greige cloth. It is preferred to treat the cloth with polymeric material to seal the cloth and to protect the cloth fibers. The treatment may involve one or more of the following treatments: a presize, a saturant or a backsize. One such treatment involves a presize coating applied first, followed by a backsize coating. Alternatively, a saturant coating, followed by a backsize coating. It is generally preferred that the front surface of the backing be relatively smooth. Likewise, the treatment coat(s) should result in the cloth backing being waterproof. Similarly, the treatment coat(s) should result in the cloth backing having sufficient strength and flexibility. One preferred backing treatment is a crosslinked urethane acrylate oligomer blended with an acrylate monomer resin. It is within the scope of this invention that the cloth treatment chemistry is identical or is similar in nature to the chemistry of the binder. The cloth treatment chemistry may further comprise additives such as: fillers, dyes, pigments, wetting agents, coupling agents, plasticizers and the like.

Other treatment coatings include thermosetting and thermoplastic resins. Examples of typical and preferred thermosetting resins include phenolic resins, aminoplast resins, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins and mixtures thereof. Examples of preferred thermoplastic resins include polyamide resins (e.g. nylon), polyester resins and polyurethane resins (including polyurethane-urea resins). One preferred thermoplastic resin is a polyurethane derived from the reaction product of a polyester polyol and an isocyanate.

In some instances it may be preferable to have an integrally molded backing, that is a backing directly molded adjacent the composites instead of independently attaching the composites to a backing (e.g., polyester film). The backing may be molded or cast onto the back of the composites after the composites are molded, or may be molded or cast simultaneously with the composites. The integrally molded backing may be molded from either thermal or radiation curable thermoplastic or thermosetting resins. Examples of typical and preferred thermosetting resins include phenolic resins, aminoplast resins, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, and mixtures thereof. Examples of preferred thermoplastic resins include polyamide resins (e.g., nylon), polyester resins and polyurethane resins (including polyurethane-urea resins). One preferred thermoplastic resin is a polyurethane derived from the reaction product of a polyester polyol and an isocyanate.

Diamond Bead Abrasive Particles

The abrasive coating of an abrasive article of the present invention comprises a plurality of diamond bead abrasive particles. As used herein the term "diamond bead abrasive particle" refers to a composite abrasive particle comprising about 6% to 65% by volume diamond abrasive particles having a diameter of 25 microns or less distributed throughout about 35% to 94% by volume microporous, nonfused, continuous metal oxide matrix The metal oxide matrix has a Knoop hardness of less than about 1000 and comprises at least one metal oxide selected from the group consisting of zirconium oxide, silicon oxide, aluminum oxide, magnesium oxide and titanium oxide. Diamond bead abrasive particles may be described as friable in that the metal oxide matrix may crumble or break under the force of abrading thereby generating a new exposed surface. Diamond bead abrasive particles are reported in U.S. Pat. No. 3,916,584 (Howard et al.), the disclosure of which is incorporated herein by reference.

In a preferred method of manufacture, diamond abrasive particles are mixed into an aqueous sol of a metal oxide (or oxide precursor) and the resultant slurry is then added to an agitated dehydrating liquid (e.g., 2-ethyl-1-hexanol). Water is removed from the dispersed slurry and surface tension draws the slurry into spheroidal composites, which are thereafter filtered out, dried, and fired. The resultant diamond bead abrasive particles are generally spherical in shape and have a size at least twice that of the diamond particles used to prepare the diamond bead abrasive particles.

The individual diamonds making up the diamond bead abrasive particles typically range in size from about 0.5 to 25 micrometers, more preferably ranging from about 3 to about 15 micrometers. The diamond bead abrasive particles typically range in size from about 5 to about 200 micrometers, more preferably ranging in size from about 6 to about 100 micrometers, and most preferably ranging in size from about 6 to about 30 micrometers.

The individual diamond abrasive particles may be natural or synthetically made diamonds. Relative to synthetically made diamonds, the particles may be considered "resin bond diamonds", "saw blade grade diamonds" or "metal bond diamonds". The diamonds may have a blocky shape associated with them or alternatively, a needle like shape. The diamond particles may contain a surface coating such as a metal coating (e.g., nickel, aluminum, copper or the like), an inorganic coating( e.g., silica) or an organic coating.

The abrasive coating typically comprises about 1 to about 30 weight percent diamond bead abrasive particles, preferably comprising about 2 to about 25 weight percent diamond bead abrasive particles. More preferably, the abrasive coating comprises by about 5 to about 15 weight percent diamond bead abrasive particles, most preferably comprising about 7 to about 13 weight percent diamond bead abrasive particles.

Filler

The abrasive coating of an abrasive article of the present invention further comprises a filler. A filler is a particulate material and generally has an average particle size range between 0.01 to 50 micrometers, typically between 0.1 to 40 micrometers. A filler is added to the abrasive coating in order to control the rate of erosion of the abrasive coating. A controlled rate of erosion of the abrasive coating during abrading is important in achieving a balance of high cut rate, consistent cut rate, and a long useful life. If the filler loading is too high, the abrasive coating may erode at a rate which is too fast thereby resulting in an inefficient abrading operation (e.g., low cut and poor useful life of the abrasive article). Conversely, if the filler loading is too low, the abrasive coating may erode at a rate which is too slow thereby allowing the abrasive particles to dull resulting in a low cut rate. The abrasive coating of an abrasive article of the present invention comprises about 40 to about 60 weight percent filler. More preferably, the abrasive coating comprises about 45 to about 60 weight percent filler. Most preferably, the abrasive coating comprises about 50 to about 60 weight percent filler.

Examples of fillers which may be suitable for use in an abrasive article of the present invention include: metal carbonates (such as calcium carbonate (chalk, calcite, marl, travertine, marble and limestone), calcium magnesium carbonate, sodium carbonate, magnesium carbonate), silica (such as quartz, glass beads, glass bubbles and glass fibers) silicates (such as talc, clays, (montmorillonite) feldspar, mica, calcium silicate, calcium metasilicate, sodium aluminosilicate, sodium silicate, lithium silicate, and potassium silicate) metal sulfates (such as calcium sulfate, barium sulfate, sodium sulfate, aluminum sodium sulfate, aluminum sulfate), gypsum, vermiculite, wood flour, aluminum trihydrate, carbon black, metal oxides (such as calcium oxide (lime), aluminum oxide, tin oxide (for example stannic oxide), titanium dioxide) and metal sulfites (such as calcium sulfite), thermoplastic particles (polycarbonate, polyetherimide, polyester, polyethylene, polysulfone, polystyrene, acrylonitrile-butadiene-styrene block copolymer, polypropylene, acetal polymers, polyurethanes, nylon particles) and thermosetting particles (such as phenolic bubbles, phenolic beads, polyurethane foam particles) and the like. The filler may also be a salt such as a halide salt. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metal fillers include, tin, lead, bismuth, cobalt, antimony, cadmium, iron titanium. Other miscellaneous fillers include sulfur, organic sulfur compounds, graphite and metallic sulfides.

Preferred fillers for imparting the desired erodibility to the abrasive coating include calcium metasilicate, white aluminum oxide, calcium carbonate, silica, and combinations thereof. A particularly preferred filler combination is calcium metasilicate and white aluminum oxide. When a fine surface finish is desired, it may be desirable to use a soft filler available in a small particle size.

Optional Additives

The abrasive coating of an abrasive article of the present invention may further comprise optional additives, such as, abrasive particle surface modification additives, coupling agents, expanding agents, fibers, antistatic agents, curing agents, suspending agents, photosensitizers, lubricants, wetting agents, surfactants, pigments, dyes, UV stabilizers, and anti-oxidants. The amounts of these materials are selected to provide the properties desired.

Coupling Agents

A coupling agent can provide an association bridge between the binder and the abrasive particles. Additionally the coupling agent can provide an association bridge between the binder and the filler particles. Examples of coupling agents include silanes, titanates, and zircoaluminates. There are various means to incorporate the coupling agent. For example, the coupling agent may be added directly to the binder precursor. The abrasive coating may contain anywhere from about 0 to 30%, preferably between 0.1 to 25% by weight coupling agent. Alternatively, the coupling agent may be applied to the surface of the filler particles. In yet another mode, the coupling agent is applied to the surface of the abrasive particles prior to being incorporated into the abrasive article. The abrasive particle may contain anywhere from about 0 to 3% by weight coupling agent, based upon the weight of the abrasive particle and the coupling agent. Examples of commercially available coupling agents include "AI74" and "AI230" from OSI. Still another example of a commercial coupling agent is an isopropyl triisosteroyl titanate commercially available from Kenrich Petrochemicals, Bayonne, N.J., under the trade designation "KR-TTS".

Suspending Agents

An example of a suspending agent is an amorphous silica particle having a surface area less than 150 meters square/gram that is commercially available from DeGussa Corp., Ridgefield Park, N.J., under the trade name "OX-50". The addition of the suspending agent can lower the overall viscosity of the abrasive slurry. The use of suspending agents is further described in U.S. Pat. No. 5,368,619.

Curing Agents

The binder precursor may further comprise a curing agent. A curing agent is a material that helps to initiate and complete the polymerization or crosslinking process such that the binder precursor is converted into a binder. The term curing agent encompasses initiators, photoinitiators, catalysts and activators. The amount and type of the curing agent will depend largely on the chemistry of the binder precursor.

Free Radical Initiators

Polymerization of the preferred ethylenically unsaturated monomer(s) or oligomer(s) occurs via a free-radical mechanism. If the energy source is an electron beam, the electron beam generates free-radicals which initiate polymerization. However, it is within the scope of this invention to use initiators even if the binder precursor is exposed to an electron beam. If the energy source is heat, ultraviolet light, or visible light, an initiator may have to be present in order to generate free-radicals. Examples of initiators (i.e., photoinitiators) that generate free-radicals upon exposure to ultraviolet light or heat include, but are not limited to, organic peroxides, azo compounds, quinones, nitroso compounds, acyl halides, hydrazones, mercapto compounds, pyrylium compounds, imidazoles, chlorotriazines, benzoin, benzoin alkyl ethers, diketones, phenones, and mixtures thereof. Am example of a commercially available photoinitiator that generates free radicals upon exposure to ultraviolet light include IRGACURE 651 and IRGACURE 184 (commercially available from the Ciba Geigy Company, Hawthorne, N.J.), and DAROCUR 1173 (commercially available from Merck). Examples of initiators that generate free-radicals upon exposure to visible light can be found in U.S. Pat. No. 4,735,632. Another photoinitiator that generates free radicals upon exposure to visible light has the trade name IRGACURE 369 (commercially available from Ciba Geigy Company).

Typically, the initiator is used in amounts ranging from 0.1% to 10%. preferably 0.5% to 2% by weight, based on the weight of the binder precursor.

Additionally, it is preferred to disperse, preferably uniformly disperse, the initiator in the binder precursor prior to the addition of any particulate material, such as the abrasive particles and/or filler.

In general, it is preferred that the binder precursor be exposed to radiation energy, preferably ultraviolet light or visible light. In some instances, certain additives and/or abrasive particles will absorb ultraviolet and visible light, which makes it difficult to properly cure the binder precursor. This phenomena is especially true with ceria abrasive particles and silicon carbide abrasive particles. It has been found, quite unexpectedly, that the use of phosphate containing photoinitiators, in particular acylphosphine oxide containing photoinitiators, tend to overcome this problem. An example of such a photoinitiator is 2,4,6 trimethylbenzoyldiphenylphosphine oxide which is commercially available from BASF Corporation, Charlotte, N.C., under the trade designation LUCIRIN TPO. Other examples of commercially available acylphosphine oxides include DAROCUR 4263 and DAROCUR 4265, both commercially available from Merck and phosphine oxide, phenyl bis (2,4,6-trimethyl benzoyl) photoinitiator commercially available from Ciba Geigy Corp, Greensboro, N.C., under the trade designation IRGACURE 819.

Photo Sensitizers

Optionally, the abrasive coating may contain photosensitizers or photoinitiator systems which affect polymerization either in air or in an inert atmosphere, such as nitrogen. These photosensitizers or photoinitiator systems include compounds having carbonyl groups or tertiary amino groups and mixtures thereof. Among the preferred compounds having carbonyl groups are benzophenone, acetophenone, benzil, benzaldehyde, o-chlorobenzaldehyde, xanthone, thioxanthone, 9,1 0-anthraquinone, and other aromatic ketones which can act as photosensitizers. Among the preferred tertiary amines are methyldlethanolamine, ethyldiethanolamine, triethanolamine, phenylmethylethanolamine, and dimethylaminoethylbenzoate. In general, the amount of photosensitizer or photoinitiator system may vary from about 0.01% to about 10% by weight, more preferably from about 0.25 to about 4.0% by weight, based on the weight of the binder precursor. Examples of photosensitizers include QUANTICURE ITX, QUANTICURE QT-X, QUANTICURE PTX, QUANTICURE EPD, all commercially available from Biddle Sawyer Corp.

Abrasive Article

The abrasive article according to the invention includes a backing having a three-dimensional abrasive coated bonded to the backing. The abrasive coating comprises a plurality of shaped abrasive composites. These abrasive composites can be precisely shaped or irregularly shaped. It is preferred that the abrasive composites be precisely shaped, because precisely shaped composites are more uniform and consistent.

Figure 2:
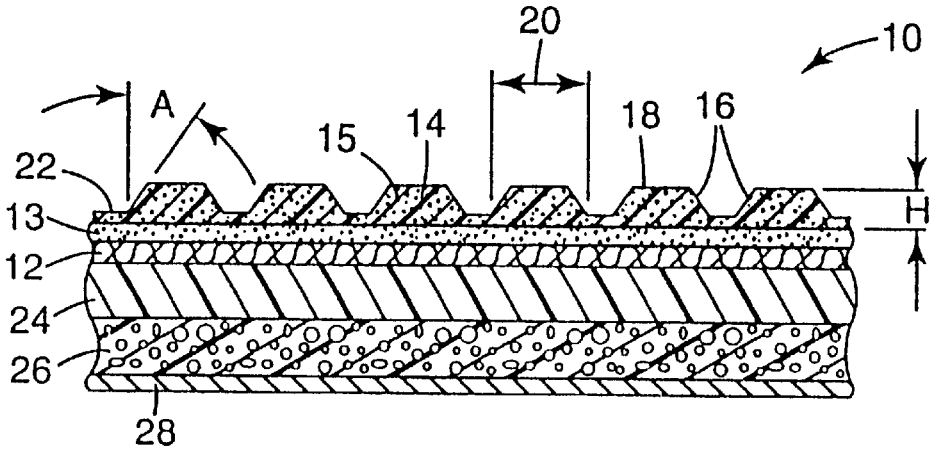
FIG. 2 is an enlarged cross section taken along the line 2—2 of the abrasive article illustrated in FIG. 1.

Referring now to the drawing figures, one preferred embodiment of an abrasive article 10 in accordance with the invention is illustrated in FIGS. 1 and 2 in plan and enlarged sectional views, respectively. The abrasive article 10 includes a backing 12 bearing on one major surface thereof abrasive composites 16. The abrasive composites 16 include a plurality of diamond bead abrasive particles 14 dispersed in a binder 15. Preferably, the binder comprises a multifunctional acrylate, most preferably a mixture of tris (hydoxyethyl) isocyanurate and trimethylolpropane triacrylate. The abrasive composites 16 further include from about 40% wt to about 60% wt filler (not shown). The binder 15 typically binds the abrasive composites 16 to the backing 12. Optionally, a presize coating or tie layer 13 may be interposed between the abrasive composites 16 and the backing 12.

The abrasive composites 16 preferably have a discernible shape. Initially, it is preferred that the diamond bead abrasive particles 14 do not protrude beyond the surface of the binder 15. As the abrasive article 10 is being used to abrade a surface, the abrasive composite breaks down to reveal unused diamond bead abrasive particles 14.

The abrasive composite shape can be any shape. Typically the cross sectional surface area of the base side of the shape that is in contact with the backing is larger in value than that of the distal end of the composite spaced from the backing. The shape of the composite can be selected from among a number of geometric shapes such as a cubic, block-like, cylindrical, prismatic, rectangular, pyramidal, truncated pyramidal, conical, truncated conical, cross, post-like with a top surface which is flat. Another shape is hemispherical and this is further described in PCT WO 95/22436. The resulting abrasive article can have a mixture of different abrasive composite shapes.

The base abrasive composites can abut one another or alternatively, the bases of adjacent abrasive composites may be separated from one another by some specified distance. It is to be understood that this definition of abutting also covers an arrangement where adjacent composites share a common abrasive material land or bridge-like structure which contacts and extends between facing sidewalls of the composites. The abrasive material land is formed from the same abrasive slurry used to form the abrasive composites. The composites are "adjacent" in the sense that no intervening composite is located on a direct imaginary line drawn between the centers of the composites.

One preferred shape of the abrasive composites 16 is generally a truncated pyramid having a flat top 18 and a base 20 that flares outward, as shown in FIG. 2. It is preferred that the height H of the abrasive composites 16 is constant across the coated abrasive article 10, but it is possible to have abrasive composites of varying heights. The height H of the composites can be a value from about 10 to about 1500 micrometers, preferably about 25 to about 1000 micrometers, more preferably from about 100 to about 600 micrometers and most preferably from about 300 to about 500 micrometers.

It is preferred that the bases 20 of adjacent abrasive composites be separated from one another by land area 22. Although not wishing to be bound by any theory, it is believed that this land area 22, or separation, provides a means to allow the fluid medium to freely flow between the abrasive composites. It is believed then that this free flow of the fluid medium tends to contribute to a better cut rate, surface finish or increased flatness. The spacing of the abrasive composites can vary from about 0.3 abrasive composite per linear cm to about 100 abrasive composite per linear cm, preferably between about 0.4 abrasive composites per linear cm to about 20 abrasive composite per linear cm, more preferably between about 0.5 abrasive composite per linear cm to about 10 abrasive composite per linear cm, and most preferably between about 6 abrasive composite per linear cm to about 7 abrasive composites per linear cm.

In one aspect of the abrasive article, there is an area spacing of at least 5 abrasive composites/$cm^2$ and preferably at least 30 abrasive composites/$cm^2$. In a further embodiment of the invention, the area spacing of composites ranges from less than 1 to about 12,000 abrasive composites/$cm^2$.

When a truncated pyramidal shape is used, the base 20 generally has a length of from about 100 to about 2000 micrometers. The sides forming the abrasive composites may be straight or tapered. If the sides are tapered, it is generally easier to remove the abrasive composites 16 from the cavities of the production tool. Angle "A" in FIG. 2 is measured from an imaginary vertical line which intersects the base 20 of the abrasive composite 16 at the point where it joins the land area 22 between the abrasive composites 16, (i.e., the imaginary line is normal to the land area 22). The -angle "A" can range from about 1 degree to about 75 degrees, preferably from about 2 degrees to about 50 degrees, more preferably from about 3 degrees to about 35 degrees, and most preferably from about 5 degrees to about 15 degrees.

In an abrading procedure, abrasive article backing 12 may be attached to subpad 24 or may be attached directly to platform 28. Subpad 24 is preferably a made of polymeric material, for example, polycarbonate. Optionally, compressible pad 26 may be interposed between subpad 24 and platform 28 to provide a cushion for the abrasive article during abrading. The compressible pad may be a polyurethane foam, rubber, elastomer, rubber foam and the like. Abrasive article backing 12 is preferably bonded to subpad 24 or platform 28 with a pressure sensitive adhesive (not shown).

Figure 3:
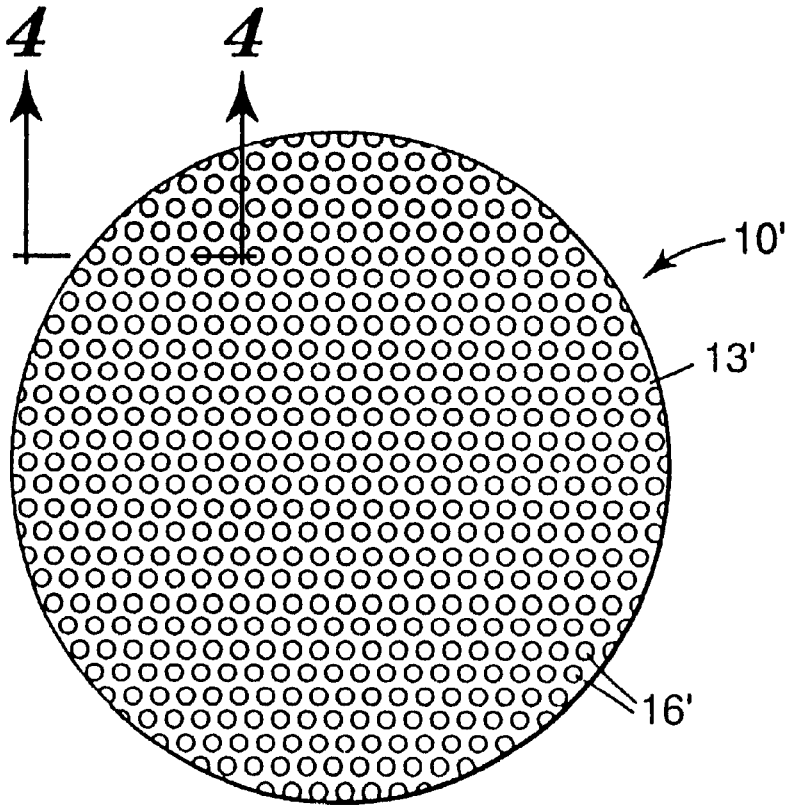
FIG. 3 is a plan view of another preferred abrasive article in accordance with the invention.
Figure 4:
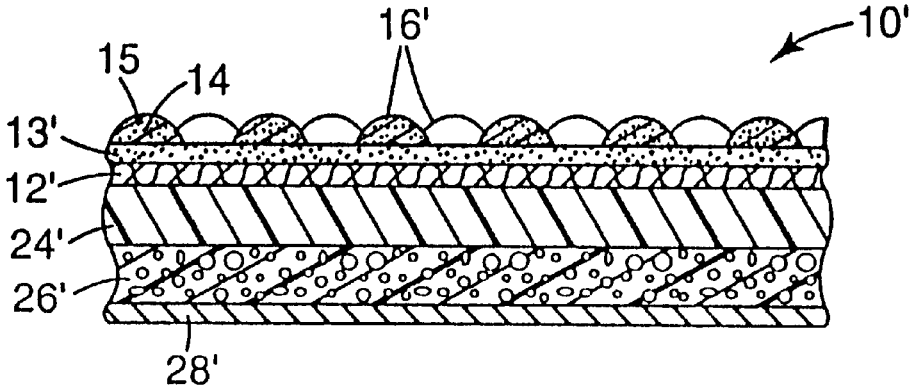
FIG. 4 is an enlarged cross section taken along 4—4 of the abrasive article illustrated in FIG. 3.

Referring now to the drawing FIGS. 3 and 4, another preferred embodiment of an abrasive article 10' in accordance with the invention is illustrated in FIGS. 3 and 4 in plan and enlarged sectional views, respectively. In this embodiment, the abrasive composites 16' are hemispherical in shape, as shown in FIG. 4. The abrasive article 10' has a woven polyester backing 12' which is sealed on one major surface with a thermoplastic polyester presize coating 13'. To the hardened presize coating 13', a slurry is applied through a screen (not shown), the slurry comprising abrasive particles and the binder precursor. The hemispherical abrasive composites 16' may vary in size and shape and may be distributed randomly or uniformly on the presize coating 13'. Preferably, the hemispherical abrasive composites 16' appear circular from a plan view, FIG. 3, and have the same diameter.

Regardless of the shape of the individual abrasive composites, preferably about 20% to about 90%, more preferably about 40% to about 70%, and most preferably about 50% to about 60%, of the surface area of the backing will be covered by abrasive composites. Additionally, the precisely shaped composites have a bottom portion defining a surface area not more than 50%, more preferably, not more than 25% and most preferably not more than 15% greater than the top surface area of the composites.

Method of Making the Abrasive Article Having Precisely Shaped Abrasive Composites The first step to make an abrasive article of the present invention is to prepare an abrasive slurry. The abrasive slurry is made by combining together by any suitable mixing technique a binder precursor, diamond bead abrasive particles, a filler and desired optional additives. Examples of mixing techniques include low shear and high shear mixing, with high shear mixing being preferred. Ultrasonic energy may also be utilized in combination with the mixing step to lower the viscosity of the abrasive slurry. Typically, the diamond bead abrasive particles are gradually added to the binder precursor. It may be preferable to add a surfactant to the binder precursor prior to adding the filler. A suitable surfactant is an anionic polyester surfactant, commercially available under the trade designation "ZYPHRUM PD 9000" (commercially available from ICI Americas, Willmington, Del.). It is preferred that the abrasive slurry be a homogeneous mixture of binder precursor, abrasive particles, filler and optional additives. If necessary water and/or solvent can be added to lower the viscosity. The amount of air bubbles in the abrasive slurry can be minimized by pulling a vacuum either during or after the mixing step. In some instances it is preferred to heat, generally in the range from about 30° C. to about 70° C., the abrasive slurry to lower the viscosity. It is important the abrasive slurry be monitored before coating to ensure a rheology that coats well and in which the abrasive particles and other fillers do not settle before coating.

To obtain a precisely shaped abrasive coating, the binder precursor is substantially solidified or cured while the abrasive slurry is present in cavities of a production tool. Alternatively, the production tool is removed from the binder precursor prior to substantial curing, resulting in a slumped, somewhat irregularly shaped side walls.

The preferred method of producing the abrasive article comprising precisely-shaped abrasive composites uses a production tool containing a plurality of cavities. These cavities are essentially the inverse shape of the desired abrasive composites and are responsible for generating the shape of the abrasive composites. The number of cavities/unit area results in the abrasive article having a corresponding number of abrasive composites/unit area. These cavities can have any geometric shape such as a cylinder, dome, pyramid, rectangle, truncated pyramid, prism, cube, cone, truncated cone or any shape having a top surface cross-section being a triangle, square, circle, rectangle, hexagon, octagon, or the like. The dimensions of the cavities are selected to achieve the desired number of abrasive composites/unit area. The cavities can be present in a dot like pattern with spaces between adjacent cavities or the cavities can butt up against one another.

The abrasive slurry can be coated into the cavities of the production tool by any conventional technique such as die coating, vacuum die coating, spraying, roll coating, transfer coating, knife coating and the like. If the production tool contains cavities that either have either flat tops or relatively straight side walls, then it is preferred to use a vacuum during coating to minimize any air entrapment.

The production tool can be a belt, a sheet, a continuous sheet or web, a coating roll such as a rotogravure roll, a sleeve mounted on a coating roll, or die. The production tool can be composed of metal, including a nickel-plated surface, metal alloys, ceramic, or plastic. Further information on production tools, their production, materials, etc. can be found in U.S. Pat. No. 5,152,917 (Pieper et al.) and U.S. Pat. No. 5,435,816 (Spurgeon et al.). One preferred production tool is a thermoplastic production tool that is embossed off of a metal master.

When the abrasive slurry comprises a thermosetting binder precursor, the binder precursor must be cured or polymerized. This polymerization is generally initiated upon exposure to an energy source. In general, the amount of energy depends upon several factors such as the binder precursor chemistry, the dimensions of the abrasive slurry, the amount and type of abrasive particles, the amount and type of filler and the amount and type of the optional additives. Radiation energy is the preferred energy source. Suitable radiation energy sources include electron beam, ultraviolet light, or visible light. Electron beam radiation can be used at an energy level of about 0.1 to about 10 Mrad. Ultraviolet radiation refers to non-particulate radiation having a wavelength within the range of about 200 to about 400 nanometers, preferably within the range of about 250 to 400 nanometers. The preferred output of the radiation source is 118 to 236 Watt/cm. Visible radiation refers to non-particulate radiation having a wavelength within the range of about 400 to about 800 nanometers, preferably in the range of about 400 to about 550 nanometers.

After the production tool is coated, the backing and the abrasive slurry are brought into contact by any suitable means such that the abrasive slurry wets the front surface of the backing. The abrasive slurry is then brought into contact with the backing by means of a contact nip roll, for example. Next, some form of energy such as described herein, is transmitted into the abrasive slurry by an energy source to at least partially cure the binder precursor. For example, the production tool can be transparent material (e.g. polyester, polyethylene or polypropylene) to transmit light radiation to the slurry contained in the cavities in the tool. By the term "partial cure" it is meant that the binder precursor is polymerized to such a state that the abrasive slurry does not flow when the abrasive slurry is removed from the production tool. The binder precursor, if not fully cured, can be fully cured by any energy source after it is removed from the production tool. Other details on the use of a production tool to make the abrasive article according to this preferred method is further described in U.S. Pat. No. 5,152,917 (Pieper et al.) and U.S. Pat. No. 5,435,816 (Spurgeon et al.).

In another variation of this first method, the abrasive slurry can be coated onto the backing and not into the cavities of the production tool. The abrasive slurry coated backing is then brought into contact with the production tool such that the abrasive slurry flows into the cavities of the production tool. The remaining steps to make the abrasive article are the same as detailed above. Relative to this method, it is preferred that the binder precursor is cured by radiation energy. The radiation energy can be transmitted through the backing and/or through the production tool. If the radiation energy is transmitted through either the backing or production tool then, the backing or production tool should not appreciably absorb the radiation energy. Additionally, the radiation energy source should not appreciably degrade the backing or production tool. For instance ultraviolet light can be transmitted through a polyester film backing.

Alternatively, if the production tool is made from certain thermoplastic materials, such as polyethylene, polypropylene, polyester, polycarbonate, poly(ether sulfone), poly(methyl methacrylate), polyurethanes, polyvinylchloride, or combinations thereof, ultraviolet or visible light can be transmitted through the production tool and into the abrasive slurry. In some instances, it is preferred to incorporate ultraviolet light stabilizers and/or antioxidants into the thermoplastic production tool. For thermoplastic based production tools, the operating conditions for making the abrasive article should be set such that excessive heat is not generated. If excessive heat is generated, this may distort or melt the thermoplastic tooling.

In some instances, it may be preferable to have an integrally molded backing, that is, the abrasive composites are directly bonded to a resin backing which is cast or molded onto the composites while the composites are still in the cavities of the mold. Preferably, the backing is molded before the binder precursor of the abrasive composites has completely cured, to allow better adhesion between the composites and the backing. It may be desirable to include a primer or adhesion promoter to the surface of the composites before the backing is cast to ensure proper adhesion of the backing.

The backing may be cast or molded from the same resin as the composites, or may be cast from a different material. Examples of particularly useful backing resins include urethanes, epoxies, acrylates, and acrylated urethanes. It is preferable that the backing does not include abrasive particles therein, since these particles would generally not be used for any grinding purposes. However, fillers, fibers, or other additives may be incorporated into the backing. Fibers may be incorporated into the backing so to increase the adhesion between the backing and the abrasive composites. Examples of fibers useful in the backings of the invention include those made from silicates, metals, glass, carbon, ceramic, and organic materials. Preferred fibers for use in the backing are calcium silicate fiber, steel fiber, glass fiber, carbon fiber, ceramic fiber, and high modulus organic fibers.

In certain applications it may be desirable to have a more durable and tear-resistant backing which can be accomplished by the inclusion of a scrim material or the like within the integrally molded backing. During molding of the backing, it is possible to lay a scrim or other material over the cavities already filled with resin (but not cured) and then apply another layer of resin over the scrim; or, it is possible to lay a scrim or other material over the uncured molded backing. Preferably, any scrim or additive backing material is sufficiently porous to allow the backing resin to penetrate through and engulf the material.

Useful scrim materials generally are lightweight, open-weave coarse fabrics. Suitable materials include metal or wire meshes, fabrics such as cotton, polyester, rayon, glass cloth, or other reinforcing materials such as fibers. The scrim or reinforcing material may be pretreated to increase the adhesion of the resin to the scrim.

After the abrasive article is made, it can be flexed and/or humidified prior to converting into a suitable form/shape before the abrasive article is used.

Method of Making Abrasive Article Having Non-Precisely Shaped Abrasive Composites A second method for making the abrasive article pertains to method in which the abrasive composites are non-precisely shaped or irregularly shaped. In this method, the abrasive slurry is exposed to an energy source once the abrasive slurry is removed from the production tool. The first step is to coat the front side of the backing with an abrasive slurry by any conventional technique such as drop die coater, roll coater, knife coater, curtain coater, vacuum die coater, or a die coater. If desired, it is possible to heat the abrasive slurry and/or subject the slurry to ultrasonics prior to coating to lower the viscosity. Next, the abrasive slurry/backing combination is brought into contact with a production tool. The production tool can be the same type of production tool described above. The production tool comprises a series of cavities and the abrasive slurry flows into these cavities. Upon removal of the abrasive slurry from the production tool, the abrasive slurry will have a pattern associated with it; the pattern of abrasive composites is formed from the cavities in the production tool. Following removal, the abrasive slurry coated backing is exposed to an energy source to initiate the polymerization of the binder precursor and thus forming the abrasive composites. It is generally preferred that the time between release of the abrasive slurry coated backing from the production tool to curing of the binder precursor is relatively minimal. If this time is too long, the abrasive slurry will flow and the pattern will distort to such a degree that the pattern essentially disappears.

In another variation of this second method, the abrasive slurry can be coated into the cavities of the production tool and not onto the backing. The backing is then brought into contact with the production tool such that the abrasive slurry wets and adheres to the backing. In this variation, for example, the production tool may be a rotogravure roll. The remaining steps to make the abrasive article are the same as detailed above.

Yet another variation is to spray or coat the abrasive slurry through a screen to generate a pattern. Then the binder precursor is cured or solidified to form the abrasive composites.

A further technique to make an abrasive article that has an abrasive coating having pattern or texture associated with it to provide a backing that is embossed and then coat the abrasive slurry over the backing. The abrasive coating follows the contour of the embossed backing to provide a pattern or textured coating.

Still another method to make an abrasive article is described in U.S. Pat. No. 5,219,462. An abrasive slurry is coated into the recesses of an embossed backing. The abrasive slurry contains abrasive particles, binder precursor and an expanding agent. The resulting construction is exposed to conditions such that the expanding agent causes the abrasive slurry to expand above the front surface of the backing. Next the binder precursor is solidified to form a binder and the abrasive slurry is converted into abrasive composites.

The abrasive article can be converted into any desired shape or form depending upon the desired application. This converting can be accomplished by slitting, die cutting or any suitable means.

Method of Abrading a Glass or a Glass Ceramic Workpiece

The preferred method of abrading a glass or glass ceramic workpiece using an abrasive article of the present invention is a "wet" abrading process using a liquid lubricant. The lubricant has several advantages associated with it. For example, abrading in the presence of a lubricant inhibits heat build up during abrading and removes the swarf away from the interface between the abrasive article and the workpiece. "Swarf" is the term used to describe the actual debris that is abraded away by the abrasive article. In some instances, the swarf may damage the surface of the workpiece being abraded. Thus it is desirable to remove the swarf from the interface. Abrading in the presence of a lubricant may also results in a finer finish on the workpiece surface.

Suitable lubricants include water-based solutions comprising one or more of the following: amines, mineral oil, kerosene, mineral spirits, water-soluble emulsions of oils, polyethylenimine, ethylene glycol, monoethanolamine, diethanolamine, triethanolamine, propylene glycol, amine borate, boric acid, amine carboxylate, pine oil, indoles, thioamine salt, amides, hexahydro-1,3,5-triethyltriazine, carboxylic acids, sodium 2-mercaptobenzothiazole, isopropanolamine, triethylenediamine tetraacetic acid, propylene glycol methyl ether, benzotriazole, sodium 2-pyridinethiol-1-oxide, and hexylene glycol. Lubricants may also include corroision inhibitors, fungi inhibitors, stabilizers, surfactants and/or emulsifiers.

Commercially available lubricants include ,for example, those known under the trade designations BUFF-O-MINT (commercially available from Ameratron Products), CHALLENGE 300HT or 605HT (commercially avialable from Intersurface Dynamics), CIMTECH GL2015, CIMTECH CX-417 and CIMTECH 100 (CIMTECH is commercially available from Cincinnati Milacron), DIAMOND KOOL or HEAVY DUTY (commercially available from Rhodes), K-40 (commercially available from LOH Optical), QUAKER 101 (commercially available from Quaker State), SYNTILO 9930 (commercially available from Castrol Industrial), TIM HM (commercially available from Master Chemical), LONG-LIFE 20/20 (commercially available from NCH Corp), BLASECUT 883 (commercially available from Blaser Swisslube), ICF-31NF (commercially available from Du Bois), SPECTRA-COOL (commercially available from Salem), SURCOOL K- 11 (commercially available from Texas Ntal), AFG-T (commercially available from Noritake), SAFETY-COOL 130 (commercially available from Castrol Industrial), and RUSTLICK (commercially available from Devoon).

One preferred lubricant for abrading a glass or glass ceramic workpiece comprises 3% wt Cimtech 100 (commercially available from Cincinnati Milicron) and 97% wt of an 80/20% wt mixture of water and glycerol. Another preferred lubricant comprises a 4% wt solution of K-40 in water (K-40 comprises a soap/surfactant and mineral oil and is commercially available from LOH Optical).

During abrading the abrasive article moves relative to the surface of the workpiece and is pressed against the workpiece surface preferably at a pressure ranging from about 0.35 g/mm$^2$ to about 7.0 g/mm$^2$, more preferably from about 0.7 g/mm$^2$ to about 3.5 g/mm$^2$, and most preferably about 2.8 g/mm$^2$. If the pressure is too high, then the abrasive article may wear excessively. Conversely, if the pressure is too low, the abrasive article may not have an acceptably high rate of cut.

As stated, the workpiece or the abrasive article or both will move relative to the other during the abrading process. This movement can be a rotary motion, a random motion, or linear motion. Rotary motion can be generated by attaching an abrasive disc to a rotary tool. The workpiece and abrasive article may rotate in the same direction or opposite directions, but if in the same direction, at different rotational speeds. In a preferred process, glass ceramic discs are held in holders which are passed between substantially parallel rotating abrasive articles which are separated at a distance. The rotating abrasive articles simultaneously abrade both major surfaces of the glass ceramic discs as the discs pass between the abrasive articles. Optionally, the disc holder may move the discs relative to the abrasive articles in a rotary pattern.

For machines, operating rpm may range up to about 4000 rpm, preferably from about 25 rpm to about 2000 rpm, and more preferably from about 50 rpm to about 1000 rpm. A random orbital motion can be generated by a random orbital tool, and linear motion can be generated by a continuous abrasive belt. The relative movement between workpiece and abrasive article may also depend on the dimensions of the workpiece. If the workpiece is relatively large, it may be preferred to move the abrasive article while the workpiece is held stationary.

In many instances, the abrasive article is bonded to a polycarbonate subpad using an attachment means such as a pressure sensitive adhesive. The subpad is then bonded to the platform also using an attachment means such as a pressure sensitive adhesive. Optionally, a compressible pad may be interposed between the subpad and the platform. The compressible pad is typically made of a compressible material such as a polyurethane foam, rubber, elastomer, rubber foam and the like. Alternatively, the abrasive article may be bonded directly to the platform using an attachment means.

Optionally, the surface of the abrasive article and supporting pads (e.g., subpad, compressible pad) may be discontinuous to provide a path for lubricant flow between the abrasive article and the workpiece.

The subpad can have any desired shape such as circular, rectangular, square, oval and the like. The subpad can range in size (longest dimension) from about 5 cm to 1500 cm.

Attachment Means

The abrasive article is secured to the subpad or platform by an attachment means. This attachment means may be a pressure sensitive adhesive, hook and loop attachment, a mechanical attachment or a permanent adhesive. The attachment means should be such that the abrasive article can be firmly secured to the subpad or platform.

Representative examples of pressure sensitive adhesives suitable for this invention include latex crepe, rosin, acrylic polymers and copolymers, for example, polybutylacrylate, polyacrylate ester, vinyl ethers (e.g., polyvinyl n-butyl ether), alkyd adhesives, rubber adhesives (e.g., natural rubber, synthetic rubber, chlorinated rubber), and mixtures thereof. The pressure sensitive adhesive may be coated out of water or an organic solvent. In some instances, it is preferred to use a rubber based pressure sensitive adhesive that is coated out of a non-polar organic solvent. Alternatively, the pressure sensitive adhesive may be a transfer tape.

Alternatively, the abrasive article may contain a hook and loop type attachment system to secure the abrasive article to the subpad or platform. The loop fabric may be on the back side of the coated abrasive with hooks on the subpad. Alternatively, the hooks may be on the back side of the abrasive article with the loops on the subpad or platform. This hook and loop type attachment system is further described in U.S. Pat. Nos. 4,609,581; 5,254,194 and 5,505,747 and PCT WO 95/19242.

Examples

The following Test Procedure and non-limiting Examples will further illustrate the invention. All parts, percentages, ratios, and the like, in the Examples are by weight unless otherwise indicated.

The following abbreviations are used throughout the examples:

Description of Materials

The following material abbreviations are used throughout the examples.

APS an anionic polyester surfactant, commercially available from ICI Americas, Inc., Wilmington, Del., under the trade designation "ZYPHRUM PD9000";

OX-50 a silica suspending agent having a surface area of 50 meters square/gram, commercially available from DeGussa Corporation, Dublin, Ohio, under the trade designation "OX-50";

Cs calcium metasilicate filler, commercially available from NYCO, Willsboro, N.Y., under the trade designation "NYAD 400 WOLLASTONITE";

IRG819 phosphine oxide, phenyl bis (2,4,6-trimethyl benzoyl) photoinitiator, commercially available from Ciba Geigy Corp., Greensboro, N.C., under the trade designation "IRGACURE 819";

SR368D acrylate ester blend, commercially available from Sartomer Company, West Chester, Pa., under the trade designation "SR368D";

PWA15 white aluminum oxide filler commercially available from Fujimi Corporation, Elmhurst, Ill., under the trade designation "PWA 15";

DIA 10–20 micrometer industrial diamond particles, commercially available from Warren Diamond Powder Co., Inc., Olyphant, Pa., under the trade designation "RB DIAMOND".

Test Procedure 1 (Strasbaugh Test)

The test machine was a modified Strasbaugh single side lap (available from R. Howard Strasbaugh, Inc. of Long Beach, Calif.). A subpad, made of 0.5 mm polycarbonate was laminated to 2.3 mm thick urethane foam and was adhered to the steel polisher platform with a pressure sensitive adhesive. A 30.5 cm abrasive pad was adhered to the subpad with a pressure sensitive adhesive. The workpiece was a titania alumino silicate glass ceramic that has an outside diameter of 84 mm, an inside diameter of 25 mm and was 0.99 mm thick. The workpiece holder utilized a spring loaded Delrin ring (about 85 mm inside diameter) to constrain the glass disc during abrading. An 84 mm diameter DF200 carrier pad (available form Rodel of Newark, N.J.) was mounted on the steel back-up plate of the workpiece holder. Then, the glass disc surface opposite the surface to be abraded was placed against the carrier pad that had been moistened with water. With no force applied, the surface of the Delrin ring protruded about 0.64 mm beyond the surface of the glass disc. The workpiece holder was brought into contact with the abrasive pad so that the Delrin ring retracted and there was direct contact of the glass disc with the abrasive pad. Sufficient force was applied so that the resultant pressure on the glass disc was about 564 grams/cm$^2$. The glass disc center was offset from the abrasive pad center about 70 mm. The abrasive pad was rotated at about 150 rpm in the clockwise direction as viewed from the top. The workpiece holder was rotated at 50 rpm, also in the clockwise direction. The lubricant was dripped directly onto the abrasive pad at a flow rate of about 80 milliliters/minute. The disc was oscillated over the abrasive pad a distance of about 25 mm. One period of oscillation was about 15 seconds. To precondition the abrasive pad, a glass disc was abraded for 15 minutes at a pressure of 564 grams/sq. cm. Then, a test disc with an approximate surface finish of 0.30 um Ra (as measured with a model Perthometer M4Pi from Mahr Corp. of Cincinnati, Ohio with a stylus tip radius of 5 um) was inserted in the workpiece holder and was abraded at a pressure of about 282 grams/cm$^2$ for three cycles with each cycle five minutes in length. A new test disc with an input finish of 0.30 um Ra was used for three additional cycles. The glass discs were weighed before and after each cycle to determine the total removal in grams. Using a disc density of 2.78 grams/cm$^3$ and a disc area of 50.51 cm$^2$, the grams of removal was converted to micrometers per minute ($\mu$m/min).

Preparation of Diamond Bead Abrasive Particles

A slurry of 200 g of Ludox LS colloidal silica dispersion (commercially available from Dupont Co., Wilmington, Del.), 0.6 g of AY-50 surfactant (commercially available from American Cyanamid, Wayne, N.J.) and 30 g of DIA (were mixed at 825–1350 rpm for 30 minutes with a sawtooth high-shear mixer (3" blade diameter). Approximately 4.75 gallons of 2-ethyl hexanol was added to a container along with 20 g of AY-50 surfactant. The above slurry was then added to 2-ethyl hexanol with continuous stirring. The mixture was agitated for 30 minutes. Then 2-ethyl hexanol was drawn off and the beads were washed with acetone. The beads were dried at 550° C. and screened to size. In this case, the beads were less than 37 $\mu$m in diameter.

Preparation Procedure of Example 1 and Comparative Examples A and B

TABLE 2

Formulations for Example 1 and Comp. Ex. A and B.

| Ingredients | Comp. Ex. A | Example 1 | Comp. Ex. B |
|---|---|---|---|
| SR368D | 37.11 | 37.11 | 55.53 |
| OX-50 | 0.76 | 0.76 | 1.04 |
| IRG819 | 0.38 | 0.38 | 0.57 |
| APS | 0.7 | 0.7 | 0.65 |
| CS | 24.15 | 24.15 | 14.56 |
| PWA15 | 29.4 | 27.9 | 16.8 |
| DIA, 15u | 7.5 | | |
| Diamond Beads | | 9 | 10.84 |

Production Tool

A production tool was made by casting polypropylene material on a metal master tool having a casting surface comprised of a collection of adjacent truncated pyramids. The metal master tool had been made by a diamond turning process. The resulting polymeric production tool contained cavities that were in the shape of four-sided truncated pyramids. The height of each truncated pyramid was about 356 micrometers (14 mils), each base was about 1427 micrometers (56 mils) per side and the top was about 1334 micrometers (52.5 mils) per side. There were approximately 445 micrometers between the bases of adjacent truncated pyramids.

Example 1 and Comparative Examples A and B were made from the abrasive slurry formulations in Table 2 using the production tool. First, the cavities of the production tool were filled with the desired abrasive slurry. Then a sheet of 0.127 mm (5 mil) polyester film with an ethylene acrylic acid prime coat was laminated to the abrasive slurry filled tooling with rubber squeeze rolls. Two medium pressure mercury bulbs at 400 watts per inch were used in series to cure the binder precursor of the abrasive slurry. The film/production tool laminate was passed under the UV lamps two times at 0.178 m/s (35 fpm). The film backing, with the structured abrasive coating adhered to it, was then separated from the production tool. The structured abrasive articles were then tested using Test Procedure 1 (Strasbaugh Test) and the results are reported in Table 3.

TABLE 3

| Strasbaugh Test Results | | | | |
|---|---|---|---|---|
| Cycle | Comp. Ex. A with lubricant (μm/min) | Example 1 with lubricant (μm/min) | Example 1 with water (μm/min) | Comp. Ex. B with lubricant (μm/min) |
| 1 | 0.99 | 2.26 | 0.83 | 1.96 |
| 2 | 0.49 | 2.16 | 0.23 | 1.52 |
| 3 | 0.32 | 2.09 | 0.13 | 1.29 |
| 4 | 0.71 | 2.24 | 0.24 | 1.43 |
| 5 | 0.31 | 2.02 | 0.1 | 1.12 |
| 6 | 0.18 | 1.88 | 0.09 | 1.02 |

Note: the lubricant used comprised 3% wt of Cimtech 100 (commercially available from Cincinnati Milicron) and 97% wt of an 80/20% wt water/glycerol mixture.

The results in Table 3 demonstrate that Example 1 with a lubricant has the highest and most consistent cut rate of the samples tested. The performance decreases when the lubricant is replaced by water, diamond bead abrasive particles are repalced by diamond particles (Comp. Ex. A), or the amount of filler is reduced (Comp. Ex. B).

What is claimed is:

1. An abrasive article suitable for abrading a glass or a glass ceramic workpiece, said abrasive article comprising:

a backing; and at least one three-dimensional abrasive coating bonded to a surface of the backing, said abrasive coating comprising a binder formed from a cured binder precursor having dispersed therein:

a plurality of diamond bead abrasive particles wherein the diamond bead abrasive particles comprise about 6% to 65% by volume diamond particles, the diamond particles distributed throughout about 35% to 94% by volume of microporous, nonfused, continuous metal oxide matrix; and a filler comprising from about 40 to about 60 percent weight of the abrasive coating.

2. The abrasive article of claim 1, wherein the metal oxide matrix has a Knoop hardness of less than 1,000 and comprises at least one metal oxide selected from the group consisting of zirconium oxide, silicon oxide, aluminum oxide, magnesium oxide and titanium oxide.

3. The abrasive article of claim 2, wherein the metal oxide matrix is silicon oxide.

4. The abrasive article of claim 1, wherein the diamond bead abrasive particles have an average particles size of about 6 to about 100 micrometers.

5. The abrasive article of claim 1, wherein the filler is selected from the group consisting of calcium metasilicate, white aluminum oxide, calcium carbonate, silica, and combinations thereof.

6. The abrasive article of claim 1, wherein the filler is calcium metasilicate and white aluminum oxide.

7. The abrasive article of claim 1, wherein the filler comprises about 50 to about 60 percent weight of the abrasive coating.

8. The abrasive article of claim 1, wherein the backing is a polymeric film selected from the group consisting of polyester film, co-polyester film, polyimide film, and polyamide film.

9. The abrasive article of claim 8, wherein the backing is polyester film having a tie layer of polyethylene acrylic acid.

10. The abrasive article of claim 1, wherein the backing and the abrasive coating are integrally molded.

11. The abrasive article of claim 10, wherein the integrally molded backing comprises a urethane polymer.

12. The abrasive article of claim 1, wherein the binder comprises a cured binder precursor selected from the group consisting of monofunctional acrylate monomers, difunctional acrylate monomers, trifunctional acrylate monomers, and mixtures thereof.

13. The abrasive article of claim 1, wherein the binder comprises a cured binder precursor comprising a mixture of tris(hydroxyethyl)isocyanurate and trimethylolpropane triacrylate.

14. The abrasive article of claim 1, wherein the three dimensional abrasive coating comprises a plurality of precisely shaped abrasive composites.

15. The abrasive article of claim 14, wherein the precisely shaped abrasive composites have a shape selected from the group consisting of cubic, block-like, cylindrical, prismatic, pyramidal, truncated pyramidal, conical, truncated conical, cross, post-like with a top surface which is flat, and hemispherical.

16. The abrasive article of claim 14, wherein the precisely shaped abrasive composites are truncated pyramids.

17. The abrasive article of claim 16, wherein the truncated pyramidal composites have a bottom surface defining a bottom surface area and a top surface defining a top surface area wherein the bottom surface area is not more than about 15% greater than the top surface area.

* * * * *

UNITED STATES PATENT AND TRADEMARK OFFICE

CERTIFICATE OF CORRECTION

PATENT NO. : 6,458,018 B1
DATED : October 1, 2002
INVENTOR(S) : Goers, Brian D.

It is certified that error appears in the above-identified patent and that said Letters Patent is hereby corrected as shown below:

Title page,
Item [56], References Cited, U.S. PATENT DOCUMENTS, please add:

| | | |
|---|---|---|
| -- 5,368,691 | 11/29/1994 | Culler |
| 5,435,816 | 7/25/1995 | Spurgeon et al. |
| 5,449,388 | 9/12/1995 | Wiand |
| 5,505,747 | 4/09/1996 | Chesley et al. |
| 5,549,961 | 8/27/1996 | Haas et al. |
| 5,580,647 | 12/3/1996 | Larson et al. |
| 5,607,488 | 3/04/1997 | Wiand |
| 5,632,790 | 5/27/1997 | Wiand |
| 5,681,217 | 10/28/1997 | Hoopman et al. |
| 5,681,362 | 10/28/1997 | Wiand |
| 5,782,682 | 7/21/1998 | Han et al. |
| 5,846,280 | 12/8/1998 | Speit |
| 5,868,953 | 2/09/1999 | Maekawa et al. |
| 5,958,794 | 9/28/1999 | Bruxvoort et al. -- |

Column 6,
Line 27, the sentence "The cloth can be a…" should not be shown as a new paragraph, it should be included with the previous paragraph.

Signed and Sealed this

Fourteenth Day of September, 2004

JON W. DUDAS
*Director of the United States Patent and Trademark Office*